US011346331B2

(12) United States Patent
Chia et al.

(10) Patent No.: US 11,346,331 B2
(45) Date of Patent: May 31, 2022

(54) HIGH-PRESSURE PUMP IN A HIGH-PRESSURE INJECTION SYSTEM OF A VEHICLE

(71) Applicant: CPT Group GmbH, Hannover (DE)

(72) Inventors: Tet Kong Brian Chia, Regensburg (DE); Dmitriy Kogan, Roding (DE)

(73) Assignee: VITESCO TECHNOLOGIES GMBH, Hanover (DE)

( * ) Notice: Subject to any disclaimer, the term of this patent is extended or adjusted under 35 U.S.C. 154(b) by 543 days.

(21) Appl. No.: 16/336,541

(22) PCT Filed: Mar. 2, 2017

(86) PCT No.: PCT/EP2017/054941
§ 371 (c)(1),
(2) Date: Mar. 26, 2019

(87) PCT Pub. No.: WO2018/054553
PCT Pub. Date: Mar. 29, 2018

(65) Prior Publication Data

US 2021/0285410 A1 Sep. 16, 2021

(30) Foreign Application Priority Data

Sep. 26, 2016 (DE) ..... 10 2016 218 426.1

(51) Int. Cl.
*F04B 7/00* (2006.01)
*F02M 59/02* (2006.01)
(Continued)

(52) U.S. Cl.
CPC ..... *F04B 7/0076* (2013.01); *F02M 59/025* (2013.01); *F02M 59/366* (2013.01);
(Continued)

(58) Field of Classification Search
CPC ..... F04B 7/0076; F04B 17/05; F04B 2201/0201; F04B 2201/06011;
(Continued)

(56) References Cited

U.S. PATENT DOCUMENTS 6,336,445 B1 1/2002 Yamazaki et al. ..... 123/506
9,404,457 B2 * 8/2016 Hironobu ..... F02M 59/102
(Continued)

FOREIGN PATENT DOCUMENTS

CN 102859178 A 1/2013 ..... F02M 55/04
CN 105604718 A 5/2016 ..... F02D 41/38
(Continued)

OTHER PUBLICATIONS

Machine Translation of DE 102012223645.*
(Continued)

*Primary Examiner* — Christopher S Bobish
(74) *Attorney, Agent, or Firm* — Slayden Grubert Beard PLLC

(57) ABSTRACT

Various embodiments include methods for operating a high-pressure pump comprising: driving a piston arranged in a compression chamber with a motor shaft; during movement of the piston toward the top dead center, closing the inlet valve so the fluid is then delivered by the piston through an outlet valve; applying a coil current to an electromagnet used to close the inlet valve during and/or after overshooting the top dead center; detecting a start time at which the coil current, on account of starting of an opening movement of the inlet valve, fulfills a predetermined change criterion; labelling a dead center rotation position of the motor shaft at which the piston is at the top dead center based at least in part on the ascertained start time; and adjusting operation of the pump based on the identified dead center rotation position.

7 Claims, 5 Drawing Sheets

(51) Int. Cl.
*F02M 59/36* (2006.01)
*F02M 59/46* (2006.01)
*F04B 17/05* (2006.01)

(52) U.S. Cl.
CPC ..... *F02M 59/466* (2013.01); *F04B 17/05* (2013.01); *F04B 2201/0201* (2013.01); *F04B 2201/06011* (2013.01); *F04B 2201/1208* (2013.01)

(58) Field of Classification Search
CPC ..... F04B 2201/1208; F02M 59/366; F02M 59/025; F02M 59/466
See application file for complete search history.

(56) References Cited

U.S. PATENT DOCUMENTS

| | | | | |
|---|---|---|---|---|
| 9,726,104 | B2 | 8/2017 | Tokuo et al. | |
| 9,926,878 | B2 * | 3/2018 | Suzuki | F02D 41/38 |
| 10,151,267 | B2 * | 12/2018 | Anetsberger | F02D 41/222 |
| 10,890,176 | B2 * | 1/2021 | Fukuda | F04B 53/14 |
| 2013/0022484 | A1 | 1/2013 | Fuchs et al. | 417/490 |
| 2013/0226488 | A1 * | 8/2013 | Wirkowski | G01B 7/14 702/64 |
| 2014/0216419 | A1 | 8/2014 | Wirkowski et al. | 123/506 |
| 2017/0342935 | A1 * | 11/2017 | Arihara | F02D 41/20 |
| 2018/0209371 | A1 * | 7/2018 | Bodensteiner | F02D 41/3845 |

FOREIGN PATENT DOCUMENTS

| | | | | |
|---|---|---|---|---|
| DE | 10023227 | A1 | 11/2001 | F02D 41/34 |
| DE | 10 2010 030 447 | A1 | 12/2011 | F02D 1/02 |
| DE | 10 2011 075 271 | A1 | 11/2012 | F02D 41/20 |
| DE | 10 2012 223 645 | B3 | 2/2014 | F02D 41/00 |
| JP | 2013032750 | A | 2/2013 | F02M 51/00 |
| WO | 2018/054553 | A1 | 3/2018 | F02D 41/00 |

OTHER PUBLICATIONS

German Office Action, Application No. 10 2016 218 426.1, 5 pages, dated Dec. 5, 2016.
International Search Report and Written Opinion, Application No. PCT/EP2017/054941, 18 pages, dated Jun. 8, 2017.
Chinese Office Action, Application No. 201780059477.9, 15 pages, dated Apr. 14, 2021.

* cited by examiner

HIGH-PRESSURE PUMP IN A HIGH-PRESSURE INJECTION SYSTEM OF A VEHICLE

CROSS-REFERENCE TO RELATED APPLICATIONS

This application is a U.S. National Stage Application of International Application No. PCT/EP2017/054941 filed Mar. 2, 2017, which designates the United States of America, and claims priority to DE Application No. 10 2016 218 426.1 filed Sep. 26, 2016, the contents of which are hereby incorporated by reference in their entirety.

TECHNICAL FIELD

The present disclosure relates to vehicles. Some embodiments may include methods for operating a high-pressure pump of a high-pressure injection system of a motor vehicle, conveying fuel into an internal combustion engine of the motor vehicle by means of the high-pressure injection system.

BACKGROUND

In a high-pressure injection system, the fuel pressure, as is generated by a high-pressure pump of the high-pressure injection system, is regulated at a setpoint pressure. An electromagnet of the inlet valve may serve as an actuator for this pressure regulation. Said valve may include a digital inlet valve (DIV), the closing time of said digital inlet valve during a delivery phase of the high-pressure pump determining how much of the pumped fluid is delivered or pressed or pumped into the high-pressure region (rail) through the outlet valve of the fuel pump. In other words, the flow rate of the high-pressure pump is dependent on the actuation time of the electromagnet of the inlet valve. Since a spring permanently presses the inlet valve toward an open position, no fuel is conveyed through the outlet valve when no current is applied to the electromagnet. The inlet valve is closed by means of the electromagnet by activating an actuation profile for the coil current of the electromagnet (the so-called peak-and-hold current profile). As a result, the fuel within the compression chamber or pump chamber can be compressed by the piston of the high-pressure pump and conveyed into the high-pressure region through the outlet valve.

Setting of the quantity conveyed and therefore of the setpoint pressure is possible in a precise manner only when the actuation takes place during the compression phase or delivery phase of the high-pressure pump, specifically while the piston is still being moved from the bottom dead center to the top dead center of its cyclical piston movement. Therefore, it is necessary to know the time of the top dead center of the piston of the high-pressure pump in order to be able to set the fuel pressure to the setpoint pressure at all. However, a time does not necessarily mean specification of a time here. The piston is generally driven by a motor shaft, for example the crankshaft of the internal combustion engine which is supplied with fuel by means of the high-pressure injection system. The top dead center can accordingly also be described by the corresponding rotation position of the motor shaft. The rotation position of the motor shaft at the top dead center of the piston is called the dead center rotation position here.

On account of manufacturing tolerances and/or due to variations in the geometry of the components involved during driving, the relationship between the rotation position of the motor shaft and the top dead center is to be ascertained by calibration. If the dead center rotation position is inaccurately estimated, this can result in the fuel pump conveying undesirably small quantities of the fluid to be pumped and having a degree of efficiency which is low in comparison to the optimum. In a worst-case scenario, the fluid to be conveyed or pumped is not conveyed at all.

SUMMARY

The present disclosure describes various methods for ascertaining the dead center rotation position in a high-pressure pump of a high-pressure injection system, which high-pressure pump is driven by a motor shaft. For example, some embodiments include a method for operating a high-pressure pump (15) of a high-pressure injection system (13) of a motor vehicle (10), wherein a piston (22) of the high-pressure pump (15), which piston is arranged in a compression chamber (33), is driven by a motor shaft (21) of the motor vehicle (10) and in the process is moved to a bottom dead center (32) in an inlet phase (30) and, at the same time, a fluid (14) flows into the compression chamber (33) via an inlet valve (16) and the piston (22) is moved to a top dead center (31) and beyond in a subsequent delivery phase (34) and as a result the fluid (14) which has flowed in is delivered from the compression chamber (33) and, during the movement (23) of the piston (22) toward the top dead center (31), the inlet valve (16) is closed by a control device (17) by application of current to an electromagnet (18) and the fluid (14) is then delivered by the piston (22) through an outlet valve (26), characterized in that a coil current (19) is further or once again applied to the electromagnet (18) by the control device (17) in the delivery phase (34) during and/or after overshooting of the top dead center (31) and a start time (44) is detected, at which start time the coil current (19), on account of starting of an opening movement of the inlet valve (16), fulfills a predetermined change criterion (45), and a dead center rotation position (46) of the motor shaft (21) at which the piston (22) is at the top dead center (31) is ascertained depending on the ascertained start time (44).

In some embodiments, the change criterion (45) stipulates that the effective coil current rises.

In some embodiments, an average value (43) of the coil current (19) is in each case ascertained at predetermined measurement times and the change criterion (45) stipulates that the start time (44) is the measurement time at which the average value (43) is greater than the average value (43) at the immediately preceding measurement time.

In some embodiments, a current intensity (I) of the coil current (19) during and/or after overshooting of the top dead center (31) is set to be smaller than is necessary at the minimum for closing the inlet valve (16).

In some embodiments, a closing force which is created by the coil current (19) is smaller than a spring force (38) of a valve spring (28) which pushes the inlet valve (16) toward an open position.

In some embodiments, the dead center rotation position (46) is back-calculated starting from a rotation position of the motor shaft (21) at the start time (44) by way of a piston stroke being ascertained, which piston stroke is necessary in order to expand the fluid (14), starting from the top dead center (31), to such an extent that the starting of the opening movement of the inlet valve (16) results.

In some embodiments, the back-calculation is carried out depending on a temperature and/or a pressure of the fluid.

As another example, some embodiments include a control device (17) for a high-pressure injection system (13) of a motor vehicle (10), wherein a processor device of the control device (17) is designed to apply a current intensity (I) of an electromagnet (18) for adjusting an inlet valve (16) of a high-pressure pump (15) of the high-pressure injection system (13) depending on a rotation position signal (20) of a motor shaft (21), characterized in that the processor device is designed to apply a coil current (19) to the electromagnet (18) in a delivery phase (34) of the high-pressure pump (15) during and/or after overshooting of a top dead center (31) of a piston (22) of the high-pressure pump (15) and to detect a start time (44) at which the coil current (19), on account of starting of an opening movement of the inlet valve (16), fulfills a predetermined change criterion (45), and to ascertain a dead center rotation position (46) of the motor shaft (21) at which the piston (22) is at the top dead center (31) depending on the ascertained start time (44).

As another example, some embodiments include a motor vehicle (10) comprising a control device (17) as described above, wherein the motor vehicle (10) is designed to carry out a method as described above.

DETAILED DESCRIPTION

Figure 1:
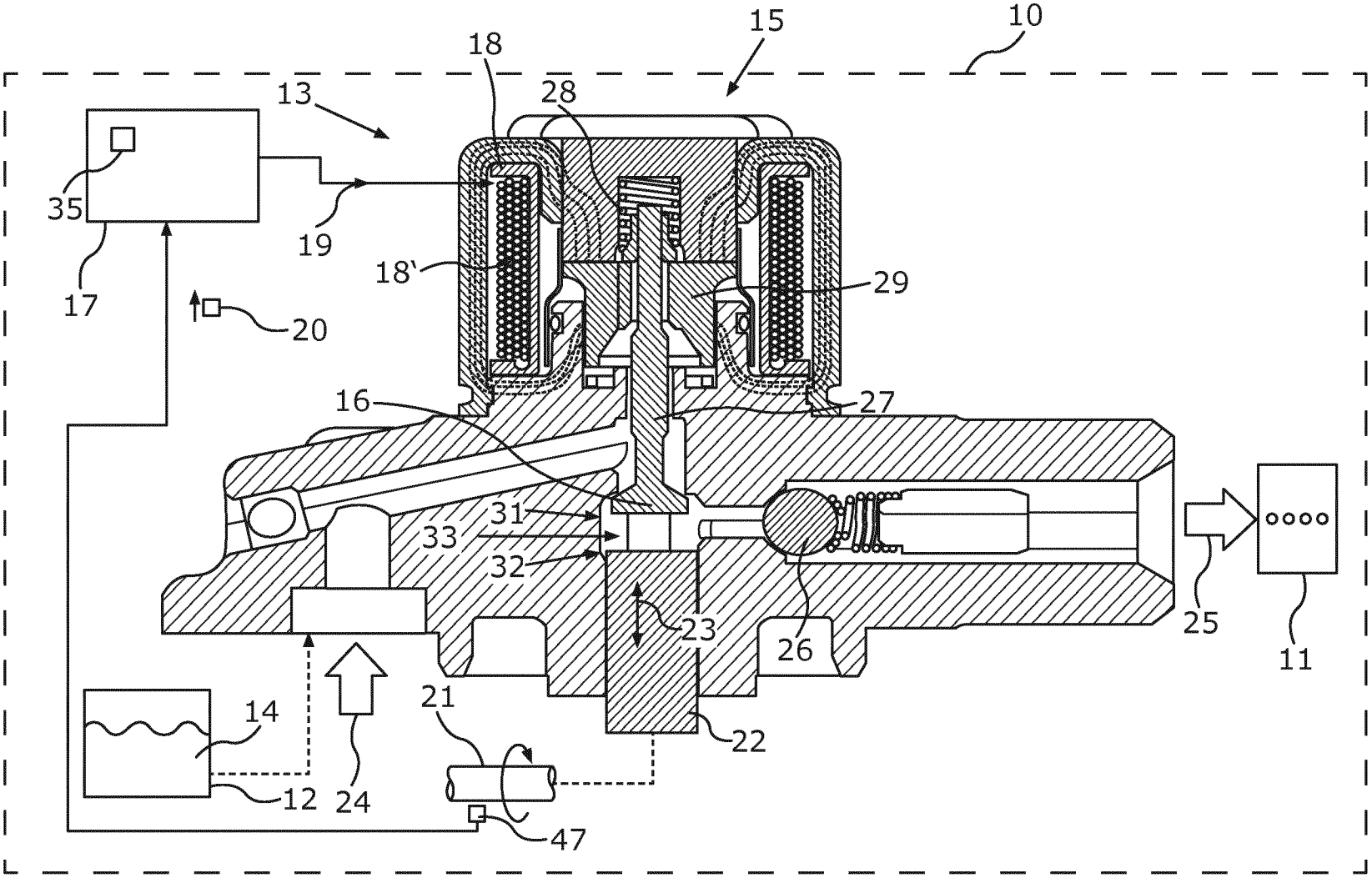
FIG. 1 shows a schematic illustration of an embodiment of the motor vehicle incorporating the teachings of the present disclosure.

The teachings of the present disclosure describe methods for operating a high-pressure pump of a high-pressure injection system of a motor vehicle. In some embodiments, a piston of the high-pressure pump is driven by a motor shaft of the motor vehicle in a manner which is known per se. As a result, the piston moves cyclically between a bottom dead center (lowest compression) and a top dead center (greatest compression) in a pump chamber or swept volume or compression chamber of the high-pressure pump. In the so-called inlet phase, the piston is moved toward the bottom dead center. At the same time, a fluid, for example a fuel, in particular diesel fuel or gasoline, flows into the compression chamber via an inlet valve. In the subsequent delivery phase, the piston is moved, starting from the bottom dead center, toward the top dead center. Here, the delivery phase is also intended to include the movement of the piston beyond the top dead center. As will be explained below, the movement beyond the top dead center does not mean that new fluid flows into the combustion chamber straightaway. The transition between the delivery phase and the subsequent inlet phase results only when the inlet valve is opened again.

In the delivery phase, the fluid which has flowed into the compression chamber is delivered from the compression chamber again. When the inlet valve is open, this takes place through the inlet valve (return flow). During the movement of the piston to the top dead center, the inlet valve is closed in the described manner, for example depending on a setpoint pressure which is to be set, by a control device by application of current to an electromagnet. Return flow of the fluid through the inlet valve is then stopped. Instead, the fluid is then delivered by the piston through an outlet valve. In this case, the coil current is no longer necessary for keeping the inlet valve closed. Specifically, after closing, the inlet valve remains automatically closed on account of the rising pressure in the compression chamber.

During this process, it is then necessary to estimate the rotation position of the motor shaft in which the piston is at the top dead center in order to be able to determine said closing time of the inlet valve depending on the setpoint pressure value. According to the invention, to this end, a coil current may remain applied to the electromagnet by the control device in the delivery phase during and/or after overshooting of the top dead center. If the electromagnet has been switched off (that is to say the coil current has been interrupted) after closing of the inlet valve, as an alternative to the above, the coil current is switched on once again, that is to say a coil current is once again applied to the electromagnet. In order to switch on the coil current in good time, it is possible to start from an estimated value or a standard value (default value) for the dead center rotation position.

While the coil current now flows through the electromagnet, a start time is detected, at which start time the coil current, on account of starting of an opening movement of the inlet valve, fulfills a predetermined change criterion. For example, a current intensity of the coil current is ascertained and the profile of said current intensity over time is checked to determine whether the change criterion is fulfilled. Therefore, the movement which is carried out by the inlet valve from the closed position into the open position is detected on the basis of the profile of the coil current over time. The starting of movement, that is to say the start time at which the inlet valve moves out of the closed position, is important here. The dead center rotation position of the motor shaft at which the piston is therefore at the top dead center is ascertained depending on the ascertained start time. Said start time, which is detected, can itself be specified as a value of the rotation position of the motor shaft. Therefore, no time measurement is then required, but rather all ascertained values can be specified as a rotation position value of the motor shaft.

In some embodiments, no complicated position measurement of the piston by means of a separate sensor is required for determining the top dead center. The dead center rotation position is indirectly ascertained from the profile of the coil current over time. To this end, the coil current will be further maintained or switched on once again after the inlet valve is closed. The methods herein may provide advantageous developments, the features of which yield additional advantages.

In some embodiments, in order to identify the starting of the opening movement, the change criterion is checked in the described manner. This change criterion stipulates, in particular, that the effective coil current rises. In other words, the opening movement of the inlet valve is identified by virtue of an induction voltage being induced in the electrical coil of the electromagnet and this leading to an additional induction current which is superimposed on the set coil current and therefore creates a larger effective coil current.

In some embodiments, to detect a rise in the effective coil current, that is to say the additional induced current, an average value of the coil current may be ascertained at specific measurement times, that is to say for example cyclically, for example at time intervals in a range of from 1 ms to 100 ms. Here, for example, the measurement values of the coil current can be combined in a range of the last millisecond through to the last 200 ms to form the respective average value. In some embodiments, the change criterion stipulates that the start time is the measurement time at which the average value is greater than the average value at the immediately preceding measurement time. In other words, provision is made, if the sequence of the measurement times rises or becomes greater with the current average value, for this to be defined as the start time.

However, the inlet valve must not be kept closed by the application of current to the inlet valve, as is provided for ascertaining the dead center rotation position, since this would otherwise prevent the opening movement from beginning at all. In some embodiments, a current intensity of the coil current during and/or after overshooting of the top dead center may be set smaller than is necessary at the minimum for closing the inlet valve. Therefore, said current is not a coil current for closing the inlet valve, but rather a measurement current.

In some embodiments, a closing force which is created by the coil current may be smaller than a spring force of the valve spring which pushes the inlet valve toward the open position. Therefore, the inlet valve is securely or reliably opened at least for the case in which the fluid is completely expanded, that is to say is expanded to the inlet pressure in the inlet or low-pressure region of the high-pressure pump.

The expansion of the fluid also has an influence on the start time at which the inlet valve opens, that is to say the opening movement starts or begins, being delayed with respect to the top dead center. This is because the inlet valve does not open as early as when the piston overshoots the top dead center, but rather opens at a later time when the piston has moved away from the top dead center and the fluid has expanded to such an extent that the spring force of the valve spring and the pressure force of the inlet pressure together are greater than the pressure of the fluid in the compression chamber. Accordingly, the dead center rotation position may be estimated more accurately by back-calculating starting from a rotation position of the motor shaft at the start time, that is to say when the inlet valve begins or starts to open, by way of a piston stroke being ascertained, which piston stroke is necessary in order to expand the fluid, starting from the top dead center, to such an extent that the starting of the opening movement of the inlet valve results. In other words, the expansion of the fluid is also taken into account. At the top dead center, the fluid is further elastically compressed in such a way that it continues to keep the inlet valve closed even as the piston continues to move. This required piston stroke until the starting of movement does not have to be recalculated for each piston movement or for each movement cycle. Pre-formed calculation values can be used for this purpose. The described back-calculation can be performed, for example, by means of a table or a characteristic map.

In some embodiments, the back-calculation may be carried out depending on a temperature and/or a pressure of the fluid. As a result, the current modulus of elasticity (E modulus) of the fluid, which modulus of elasticity changes as the temperature and/or the pressure of the fluid changes, can be taken into account. This makes ascertaining the dead center rotation position more precise.

In some embodiments, there is a control device for a high-pressure injection system of a motor vehicle provided to carry out the methods described herein. In some embodiments, the control device has a processor device which is designed to switch or to adjust a current intensity of an electromagnet for adjusting an inlet valve of the high-pressure pump depending on a rotation position signal of a motor shaft which can drive the piston of a high-pressure pump of the high-pressure injection system. By virtue of adjusting the current intensity, the electromagnet is firstly activated in order to close the inlet valve and as a result to conduct the delivered fluid through the outlet valve in the described manner. By virtue of shutting off or blocking or terminating the coil current, the inlet valve is then opened again depending on the spring force of the valve spring and the pressure conditions in the inlet valve.

However, the control device can also adjust said measurement current. To this end, the processor device may be designed to apply a coil current, which constitutes the measurement current, to the electromagnet in the delivery phase of the high-pressure pump during and/or after overshooting of the top dead center of the piston of the high-pressure pump. Furthermore, the control device is designed to detect a start time at which the coil current, on account of starting of an opening movement of the inlet valve, fulfills the change criterion. The dead center rotation position of the motor shaft at which the piston is at the top dead center is then ascertained by the processor device depending on the ascertained start time.

In some embodiments, a motor vehicle comprises the control devices described herein. Overall, the motor vehicle is designed to carry out an embodiment of the methods described. Therefore, a piston of a high-pressure pump of a high-pressure injection system of the motor vehicle is thus driven by means of a motor shaft, so that said piston is cyclically moved back and forth between the bottom dead center and the top dead center in the compression chamber.

In the description following, the components each represent individual features which are to be considered independently of one another and which each also develop the teachings independently of one another and can therefore also be considered to be a component of the teachings, either individually or in a combination other than that shown. Furthermore, further features that have already been described can also be added to the described embodiment. In the figures, functionally identical elements are each provided with the same reference symbols.

FIG. 1 shows a motor vehicle 10, which may be, for example, an automobile, such as a passenger car or truck for example. The motor vehicle 10 can have an internal combustion engine 11 which can be coupled to a fuel tank 12 by means of a high-pressure injection system 13 by means of which a fluid 14, that is to say a fuel for example, such as diesel or gasoline for example, which is contained in the fuel tank 12 can be conveyed to the internal combustion engine 11. To this end, the high-pressure injection system 13 can have a high-pressure pump 15 comprising an inlet valve 16 and a control device 17 for controlling an electromagnet 18 of the inlet valve 16. The control device 17 can adjust a coil current 19 which flows through an electrical coil 18' of the electromagnet 18.

The control device 17 can adjust the coil current 19 depending on a rotation position signal 20 which describes or indicates a rotation position of a motor shaft 21 of the motor vehicle 10. The motor shaft 21 can be coupled, for example, to a crankshaft of the internal combustion engine 11. The motor shaft 21 may also be the crankshaft itself. A piston 22 of the high-pressure pump 15 is also driven by the motor shaft 21 to perform a piston movement 23. The fluid 14 is conveyed from a low-pressure side 24 of the high-pressure pump 15 to a high-pressure side 25 by the piston movement 23 of the piston 22 in a compression chamber 33. In the process, the fluid 14 flows through the inlet valve 16 and an outlet valve 26.

In the process, a pin 27 of the inlet valve 16 is moved by means of the coil current 19, by application of the current to the coil 18' of the electromagnet 18. In this case, a valve spring 28 counteracts the magnetic force of the electromagnet 18 and in this way pushes the pin 27 toward an open position, as is shown in FIG. 1. By virtue of adjusting the coil current 19, the spring force of the valve spring 28 is overcome and a fitting 29 with the pin 27 fastened to it is moved counter to the spring force of the valve spring 28 and the inlet valve 16 is closed in this way.

Figure 2:
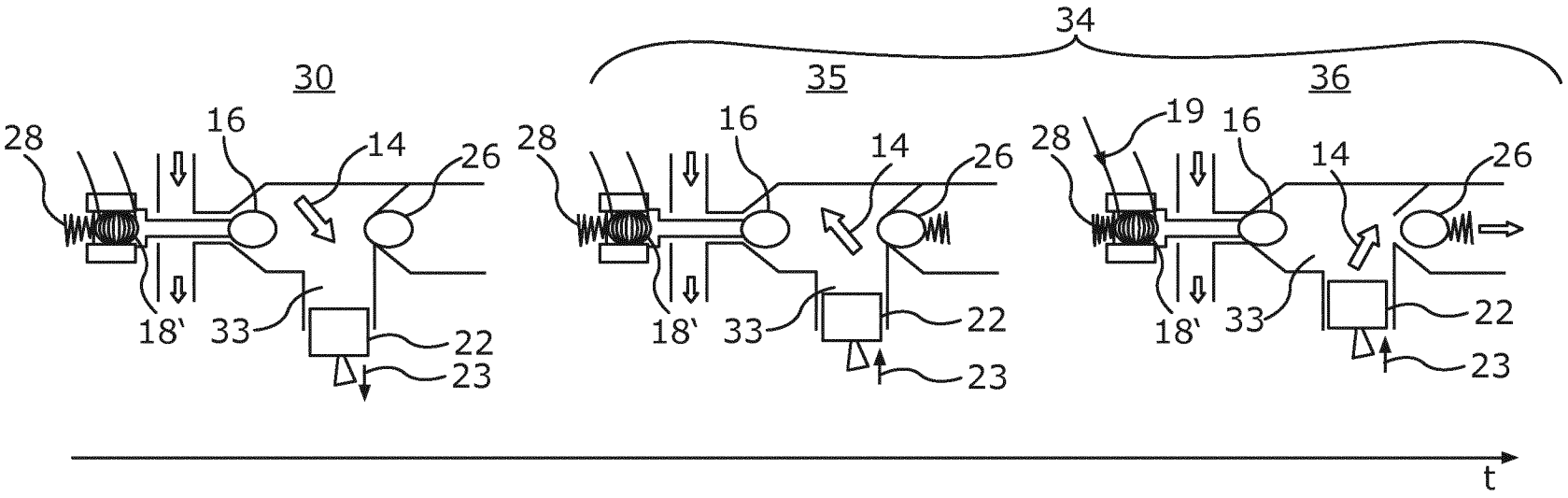
FIG. 2 shows a diagram for illustrating a sequence of valve positions of an inlet valve of a high-pressure injection system of the motor vehicle from FIG. 1.

FIG. 2 illustrates how the fluid 14 is conveyed in this way. In an inlet phase 30, the inlet valve is opened and the piston 22 is moved from a top dead center 31 (see FIG. 1) toward the bottom dead center 32. The fluid 14 flows into the compression chamber 33 through the inlet valve 16. Owing to the piston movement 23, the piston 22 is moved back and forth between a top dead center 31 and a bottom dead center 32 in a compression chamber 33.

In a subsequent delivery phase 34, the piston 22 is moved, starting from the bottom dead center 32, toward the top dead center 31 (see FIG. 1) owing to the piston movement 23. The inlet valve 16 is still open and as a result the piston 22 delivers fluid 14 from the compression chamber 33 back through the inlet valve 16 (return flow 35). Depending on a prespecified setpoint pressure P0, the control device 17 applies current to the electromagnet 18 if the rotation position signal 20 of the motor shaft 21 has an appropriate value. As a result, current is applied to the electromagnet 18 or said electromagnet is switched on, and the inlet valve 16 is closed. The piston 22 moves further in the direction of the top dead center and as a result compresses the fluid 14 in the compression chamber 33 until the pressure in the compression chamber 33 is high enough to open the outlet valve 26 and to deliver the fluid 14 into the high-pressure side 25 through the outlet valve 26 (pumping process 36).

Figure 3:
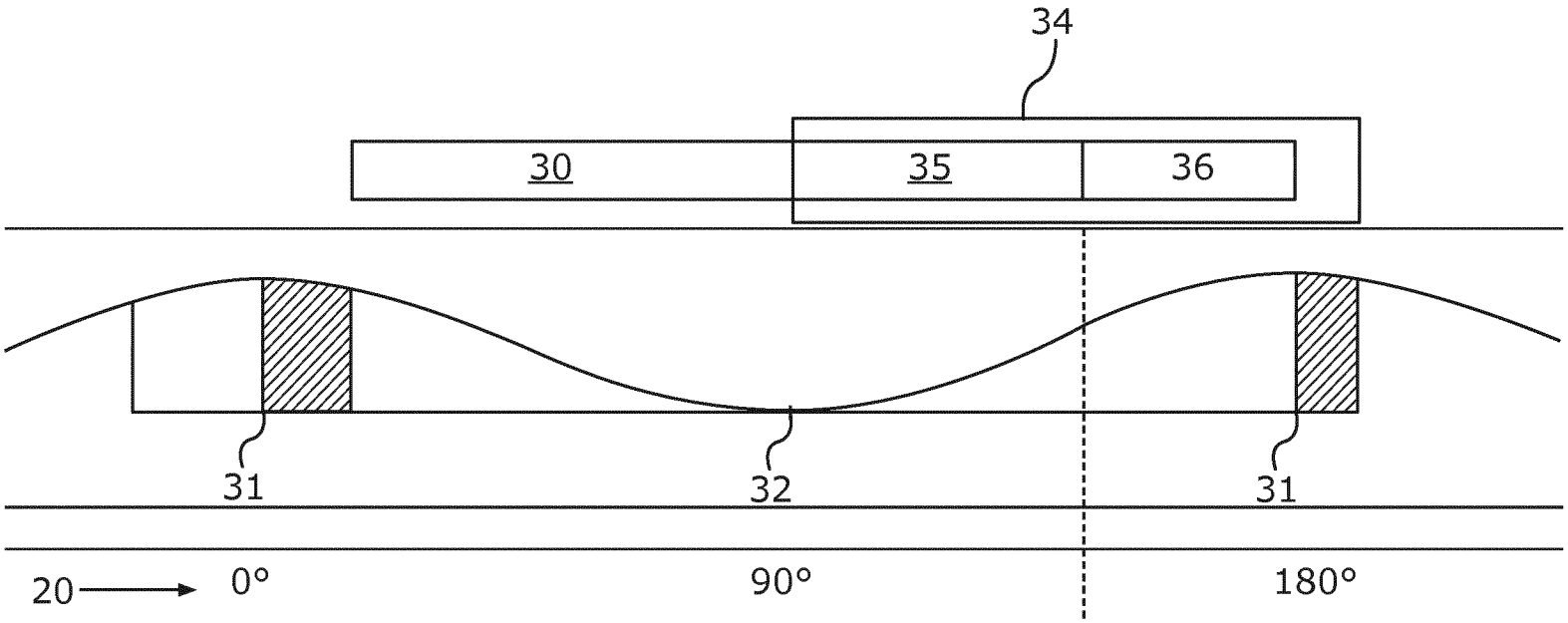
FIG. 3 shows a diagram for illustrating a sequence of an inlet phase and a delivery phase with a cyclical movement of a piston of the high-pressure pump incorporating the teachings of the present disclosure.

FIG. 3 illustrates this process once again depending on the rotation position of the motor shaft 21 indicated by the rotation position signal 20, wherein it is assumed here that the sequence comprising the inlet phase 30 and the delivery phase 34 including the return flow 35 and the pumping process 36 takes place twice for each complete revolution of the motor shaft 21. Once the piston 22 has reached the top dead center 31, it is moved back to the bottom dead center 32 owing to the rotational movement of the motor shaft 21. In the process, however, the inlet valve 16 does not open immediately, even if the coil current 19 is switched off. This is indicated by hatching in FIG. 3.

Figure 4:
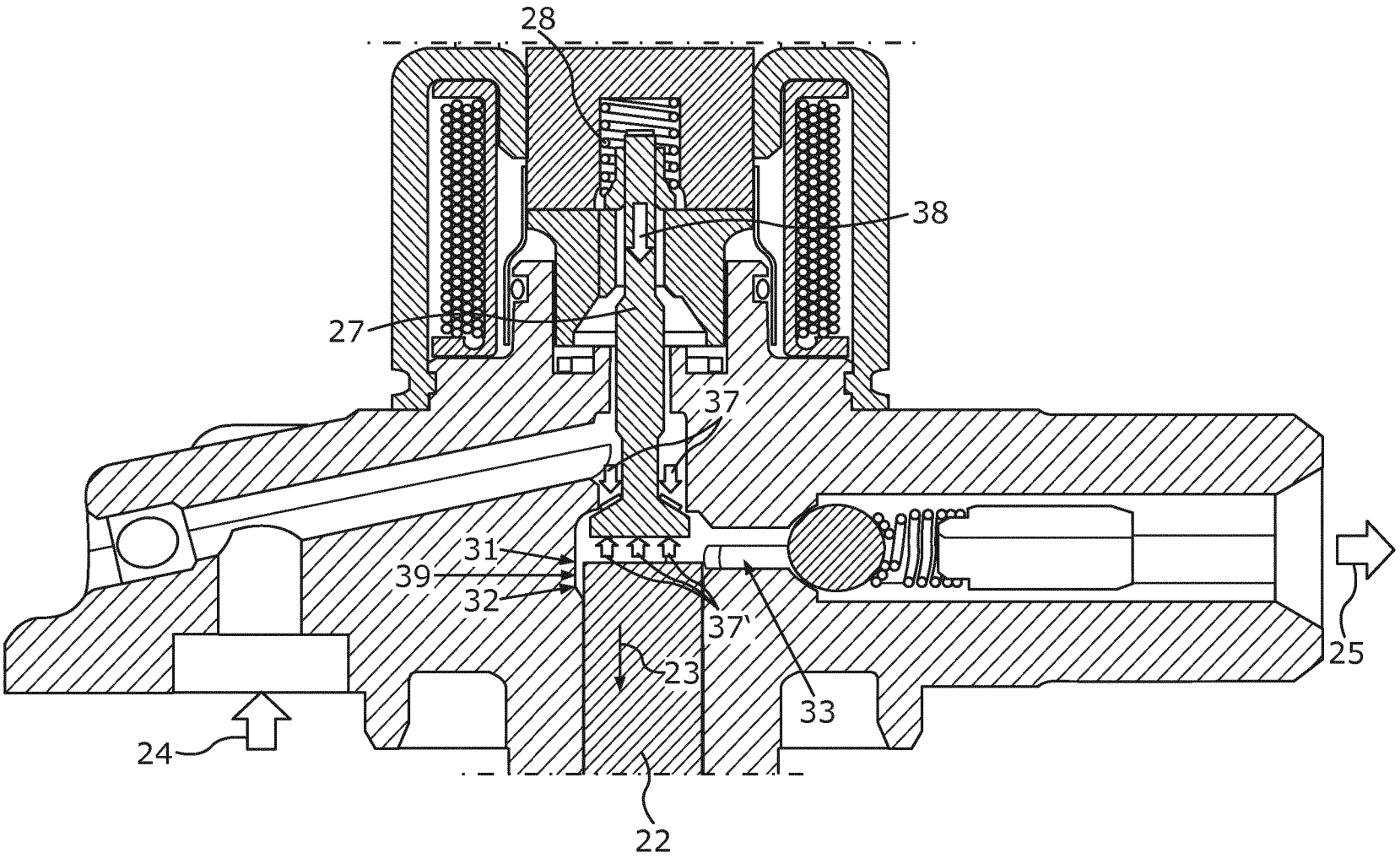
FIG. 4 shows a schematic illustration of the high-pressure pump of the motor vehicle from FIG. 1 while the piston of said high-pressure pump is moving away from the top dead center and an opening movement of the inlet valve is beginning.

FIG. 4 illustrates how the pin 27 is held in the closed position illustrated in FIG. 4 even when there is no coil current 19 flowing. The reason for this is that the low pressure 37 together with the spring force 38 of the valve spring 28 is lower than the pressure force 37' of the compressed fluid 14 in the compression chamber 33 even after overshooting of the top dead center 31. The piston 22 first has to reach a predetermined intermediate position 39 between the top dead center 31 and the bottom dead center 32, so that the fluid 14 in the compression chamber 33 is expanded to a sufficient extent so that the pressure in the compression chamber 33 produces a pressure force 37' which is low enough to move the pin 27 from the closed position, shown in FIG. 4, toward the open position, shown in FIG. 1, by means of the spring force 38 and the low pressure 37.

Figure 5:
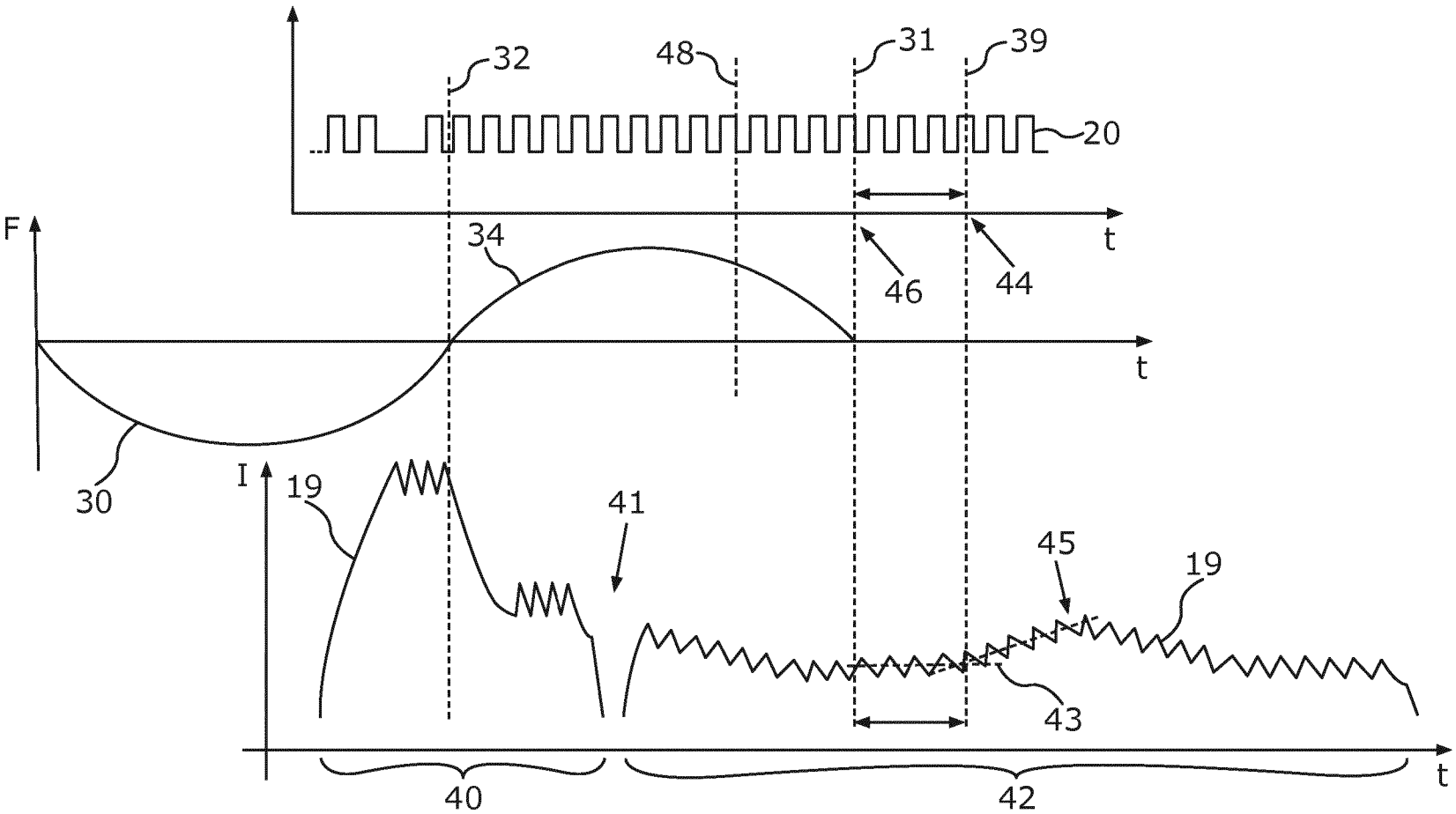
FIG. 5 shows graphs for illustrating a method for ascertaining the dead center rotation position of a motor shaft of the motor vehicle incorporating the teachings of the present disclosure.

FIG. 5 shows how, firstly, the starting of this opening movement of the inlet valve 16, that is to say the pin 27 of said inlet valve, can be identified by the control device 17 and how, secondly, starting from this point, it is possible to back-calculate that value of the rotation position signal 20 of the motor shaft 21 which results when the piston 22 is at the top dead center 31.

FIG. 5 illustrates, here, with respect to time t, firstly the fluid flow F, the rotation position signal 20 which can be generated by a rotation position transmitter 47 for example as a pulse sequence, and a profile of the coil current 19 over time. In the example illustrated in FIG. 5, it is assumed that there should be no return flow 35, but rather that the inlet valve is closed at the bottom dead center 32 by adjusting a current profile 40 for the coil current 19. After the end of the current profile 40, the coil current 19 can be switched off in a switching interval 41. On the basis of, for example, a standard value or a previously estimated dead center rotation position, the coil current 19 with a measurement profile 42 can be switched on again by the control device 17, wherein the measurement profile 42 produces a current intensity I which is lower than the current intensity I of the current profile 40 for closing the inlet valve 16. After the top dead center 31 has been passed by the piston 22, an average value of the current intensity I of the coil current 19 remains constant or within a predetermined tolerance range until starting of the opening movement of the pin 27 of the inlet valve 16 occurs at a start time 44. At the start time 44, a force balance is equalized as described in FIG. 4. In other words, the inlet valve 16 opens at the start time 44 when the spring force 38 and the hydraulic force of the low pressure 37 together are greater than the hydraulic pressure force 37' in the compression chamber 33. This occurs when the pressure in the compression chamber 33, that is to say in the free dead volume of said compression chamber, has reduced owing to the piston movement 23 in the direction of the bottom dead center 32 (intermediate position 39).

The movement of the pin 27 and the fitting 29 induces an additional induction current in the electrical coil 18', this additional induction current leading to an increase 45 in the effective value or average value 43. The beginning of this increase 45 constitutes a change criterion. The start time 44 can be detected by the control device 17 by comparison of the average values 43 of successive time points.

Taking into account the current modulus of elasticity of the fluid 14, it is possible to ascertain the dead center rotation position 46 of the motor shaft 21 at which the piston 22 was at the top dead center 31 or else is at the top dead center in the next pumping cycle. A calculation example for back-calculation of the dead center rotation position 46 from the start time 44 is specified below.

An increase in current in the reduced measurement profile 42 is the natural opening point (NOP) of the inlet valve. NOP occurs at the starting of movement of the valve. Before this, the inlet valve remains closed since a pressure which prevents opening of the inlet valve prevails within the compression chamber 33. The valve will only move when the spring force and the force resulting from the pressure on the low-pressure side become greater than the hydraulic force prevailing in the compression chamber. This can occur only when the pressure in the compression chamber is reduced owing to the piston movement in the direction of the bottom dead center:

(spring force when the valve is closed+hydraulic force in the low-pressure side)>(hydraulic force in the compression chamber 33)=>inlet valve 16 can move minimum compression chamber pressure=(spring force when the valve is closed+hydraulic force on the low-pressure side)/surface area For example, in the case of an idling internal combustion engine (preliminary pressure: 5 bar; diesel)

$(14.25\ N+(500000\ Pa*1.6578415\times10^{-5}\ m^2))/2.55\times10^{-5}\ m^2=883882\ Pa$ or 0.88 Mpa That is to say, the valve can only move when the compression chamber pressure is below 0.88 MPa.

In order to achieve the lowest compression chamber pressure, the piston has to reach a specific stroke height in the direction of the bottom dead center, that is to say as far as intermediate position 39.

The piston stroke required for this purpose can be calculated using Bernoulli's equation:

volume=(current high pressure of the high-pressure side−minimum compression chamber pressure)/E modulus*dead volume For example, in the case of motor idling (high pressure: 20 Mpa; fuel temperature: 40° C.; diesel; pump-to-motor ratio: 1:1):

$(20000000\ Pa-383882\ Pa)/13555\times10^5\ Pa*0.10461\ ml=0.001475\ ml$ minimum piston travel=travel-to-volume ratio (can be provided as a table of values or characteristic curve)=3.28° crankshaft (KW)

That is to say, the pressure in the compression chamber is expanded to the "minimum compression chamber pressure" owing to a piston travel of 3.28° KW.

Therefore, the top dead center 31 of the high-pressure pump can then be calculated by:

top dead center=NOP position (start time 44) minus the minimum piston travel (3.28° KW)

For example: when the NOP position is 7° KW (rotation position signal 20 has the rotation position value 7° KW for the start time 44) for example in relation to a top dead center 48 of the internal combustion engine 11 itself, the top dead center 31 of the high-pressure pump is given by: 7°-3.28°=3.72° KW after the top dead center of the internal combustion engine 11.

In the described method, identifying the top dead center 31 of the high-pressure pump is achieved, in particular, using software. This is not only a cost-effective solution but rather also more accurate than the previously available solutions using a position sensor for the piston 22. Overall, the example shows how a top dead center can be identified using the teachings herein in a high-pressure pump of a high-pressure injection system.

What is claimed is:

1. A method for operating a high-pressure pump of a high-pressure injection system of a motor vehicle, the method comprising:

driving a piston of the high-pressure pump, the piston arranged in a compression chamber, with a motor shaft of the motor vehicle, wherein the piston reaches a bottom dead center in an inlet phase when a fluid flows into the compression chamber via an inlet valve and the piston reaches a top dead center in a subsequent delivery phase when the fluid is delivered from the compression chamber;

during movement of the piston toward the top dead center, closing the inlet valve with a control device by applying a current to an electromagnet so the fluid is then delivered by the piston through an outlet valve;

applying a coil current to the electromagnet using the control device in the delivery phase during and/or after overshooting the top dead center;

detecting a start time at which the coil current, on account of starting of an opening movement of the inlet valve, fulfills a predetermined change criterion;

identifying a dead center rotation position of the motor shaft at which the piston is at the top dead center based at least in part on the ascertained start time; and adjusting an intensity of the coil current based on the identified dead center rotation position;

wherein the predetermined change criterion comprises an increase in the intensity of the coil current averaged over a time span.

2. The method as claimed in claim 1, further comprising setting a current intensity of the coil current during and/or after overshooting of the top dead center smaller than is necessary at the minimum for closing the inlet valve.

3. The method as claimed in claim 1, wherein a closing force created by the coil current is smaller than a spring force of a valve spring pushing the inlet valve toward an open position.

4. The method as claimed in claim 1, further comprising calculating the dead center rotation position starting from a rotation position of the motor shaft at the start time by ascertaining a piston stroke necessary to expand the fluid, starting from the top dead center, to such an extent that the starting of the opening movement of the inlet valve results.

5. The method as claimed in claim 4, wherein the calculation depends at least in part on a temperature and/or a pressure of the fluid.

6. A control device for a high-pressure injection system of a motor vehicle, the control device comprising:

a processor programmed to apply a current to an electromagnet for actuating an inlet valve of a high-pressure pump of the high-pressure injection system depending on a rotation position signal of a motor shaft;

the processor further programmed to apply a coil current to the electromagnet in a delivery phase of the high-pressure pump during and/or after overshooting of a top dead center of a piston of the high-pressure pump;

the processor further programmed to detect a start time at which the coil current, on account of starting of an opening movement of the inlet valve, fulfills a predetermined change criterion; and the processor further programmed to ascertain a dead center rotation position of the motor shaft at which the piston is at the top dead center based on the ascertained start time and adjust an intensity of the coil current based on the ascertained dead center rotation position;

wherein the predetermined change criterion comprises an increase in the intensity of the coil current averaged over a time span.

7. A motor vehicle comprising:

an internal combustion engine with a combustion chamber;

a high-pressure pump delivering fuel into the combustion chamber by movement of a piston;

an inlet valve allowing or blocking delivery of fuel to the high-pressure pump; and a processor programmed to apply a current to an electromagnet for actuating the inlet valve based at least in part on a rotation position signal of a motor shaft;

the processor further programmed to apply a coil current to the electromagnet in a delivery phase of the high-pressure pump during and/or after overshooting of a top dead center of a piston of the high-pressure pump;

the processor further programmed to detect a start time at which the coil current, on account of starting of an opening movement of the inlet valve, fulfills a predetermined change criterion; and the processor further programmed to ascertain a dead center rotation position of the motor shaft at which the piston is at the top dead center based on the ascertained start time and adjust an intensity of the coil current based on the ascertained dead center rotation position;

wherein the predetermined change criterion comprises an increase in the intensity of the coil current averaged over a time span.

* * * * *